US009799968B2

(12) United States Patent
Lin

(10) Patent No.: US 9,799,968 B2
(45) Date of Patent: Oct. 24, 2017

(54) WIRE TERMINAL CONNECTOR

(71) Applicant: Excel Cell Electronic Co., Ltd., Taichung (TW)

(72) Inventor: Chih-Ming Lin, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 15/405,631

(22) Filed: Jan. 13, 2017

(65) Prior Publication Data

US 2017/0207554 A1 Jul. 20, 2017

(30) Foreign Application Priority Data

Jan. 18, 2016 (TW) ..... 105101322 A

(51) Int. Cl.

| | |
|---|---|
| ***H01R 11/22*** | (2006.01) |
| ***H01R 4/48*** | (2006.01) |
| ***H01R 4/70*** | (2006.01) |
| ***H01R 13/633*** | (2006.01) |

(52) U.S. Cl.

CPC ..... *H01R 4/48* (2013.01); *H01R 4/70* (2013.01); *H01R 13/633* (2013.01); *H01R 4/4818* (2013.01); *H01R 4/4836* (2013.01)

(58) Field of Classification Search

CPC ..... H01R 4/4818; H01R 4/4836
USPC ..... 439/857, 835, 441
See application file for complete search history.

(56) References Cited

U.S. PATENT DOCUMENTS

| | | | | |
|---|---|---|---|---|
| 8,328,586 | B2 * | 12/2012 | Bies | H01R 4/4836 439/725 |
| 9,263,822 | B2 * | 2/2016 | Wu | H01R 13/2407 |
| 9,472,871 | B2 * | 10/2016 | Lin | H01R 12/53 |
| 9,543,682 | B2 * | 1/2017 | Jin | H01R 4/4836 |
| 9,570,817 | B1 * | 2/2017 | Wang | H01R 4/4818 |

FOREIGN PATENT DOCUMENTS

| | | |
|---|---|---|
| TW | 201212434 A | 3/2012 |
| TW | M514127 U | 12/2015 |

* cited by examiner

*Primary Examiner* — Tho D Ta
(74) *Attorney, Agent, or Firm* — Trop Pruner & Hu, P.C.

(57) ABSTRACT

A wire terminal connector is adapted for connecting with an electrical lead, and includes an insulating case unit formed with an entrance hole, and a conductive unit received in the case unit and including a base member, two resilient clamping plates and a receiving space. Each of the clamping plates has a main portion extending from the base member, a clamping portion extending from the main portion in a direction away from the entrance hole, and a pressed portion extending from the clamping portion away from the base member. The receiving space has a quadrilateral cross section, is constricted in the direction and receives the lead. The clamping portions removably clamp the lead. Each clamping portion has a height less than that of the main portion.

7 Claims, 12 Drawing Sheets

WIRE TERMINAL CONNECTOR

CROSS-REFERENCE TO RELATED APPLICATION

This application claims priority of Taiwanese Patent Application No. 105101322, filed on Jan. 18, 2016.

FIELD

The disclosure relates to a wire terminal connector, more particularly to a wire terminal connector for connecting with an electrical lead.

BACKGROUND

Referring to FIGS. 1 to 3, a conventional wire terminal connector s used for connecting with an electrical lead (not shown), and includes an insulating case unit 11 formed with a hole 111, and a conductive unit 12 received in the insulating case unit 11.

The conductive unit 12 includes a base member 121, two resilient clamping plates 122 and two pressed members 124. Each of the resilient clamping plates 122 extends upwardly from two opposite sides of the base member 121, and each of the pressed members 124 extends upwardly from a respective one of the resilient clamping plates 122 and corresponds in position to the hole 111 of the insulating case unit 11. The base member 121 and the resilient clamping plates 122 cooperatively define a receiving space 123 that is adapted for receiving the electrical lead. When the electrical lead is connected to the conventional wire terminal connector, the clamping members 122 clamp the electrical lead.

When applying the conventional wire terminal connector to large-scale electronic equipment, it is desired to reduce the overall vertical height of the conventional wire terminal connector in order to save space. However, the height of each of the clamping members 122 impose undesired limitation to the overall height of the conventional terminal connector.

Moreover, when disconnecting the electrical lead from the conventional wire terminal connector, a user may have to use a pressing tool 19 (see FIG. 3) to press the pressed members 124 through the pressing hole 111 to thereby push the clamping members 122 away from each other to release the electrical lead. The necessity of the pressing tool 19 results in inconvenient use.

SUMMARY

Therefore, an object of the present disclosure is to provide a wire terminal connector that can alleviate at least one of the drawbacks associated with the prior art.

According to the present disclosure, a wire terminal connector is adapted for connecting with an electrical lead, and includes an insulating case unit and a conductive unit.

The insulating case unit is formed with an entrance hole adapted for the electrical lead to be inserted therethrough.

The conductive unit is received in the insulating case unit, and includes a base member, two resilient clamping plates and a receiving space. Each of the resilient clamping plates has a main portion, a clamping portion and a pressed portion. The main portion of each of the resilient clamping plates extends from the base member. The clamping portion of each of the resilient clamping plates extends from the main portion of the corresponding resilient clamping plate in a direction away from the entrance hole of the insulating case unit. The receiving space is defined by the base member and the resilient clamping plates, has a quadrilateral cross section, is constricted in the direction away from the entrance hole in a stepwise manner, and is adapted for receiving the electrical lead. The clamping portions of the resilient clamping plates cooperate to removably clamp the electrical lead. The pressed portion of each of the resilient clamping plates extends from the clamping portion of a corresponding one of the resilient clamping plates in a direction away from the base member. The clamping portion of each of the resilient clamping plates has a height measured from the base member and less than that of the main portion of the corresponding one of the resilent clamping plates.

BRIEF DESCRIPTION OF THE DRAWINGS

Other features and advantages of the present disclosure will become apparent in the following detailed description of the embodiment with reference to the accompanying drawing, of which.

DETAILED DESCRIPTION

Figure 4:
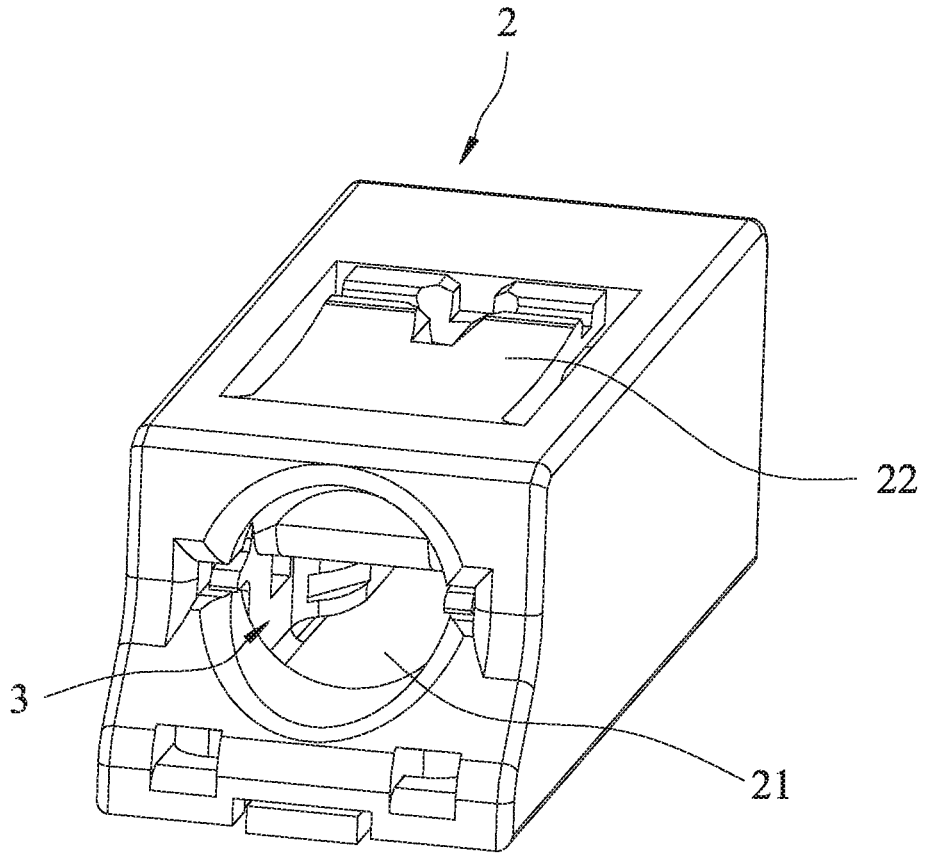
FIG. 4 is a perspective view of an embodiment of a wire terminal connector according to the disclosure.
Figure 5:
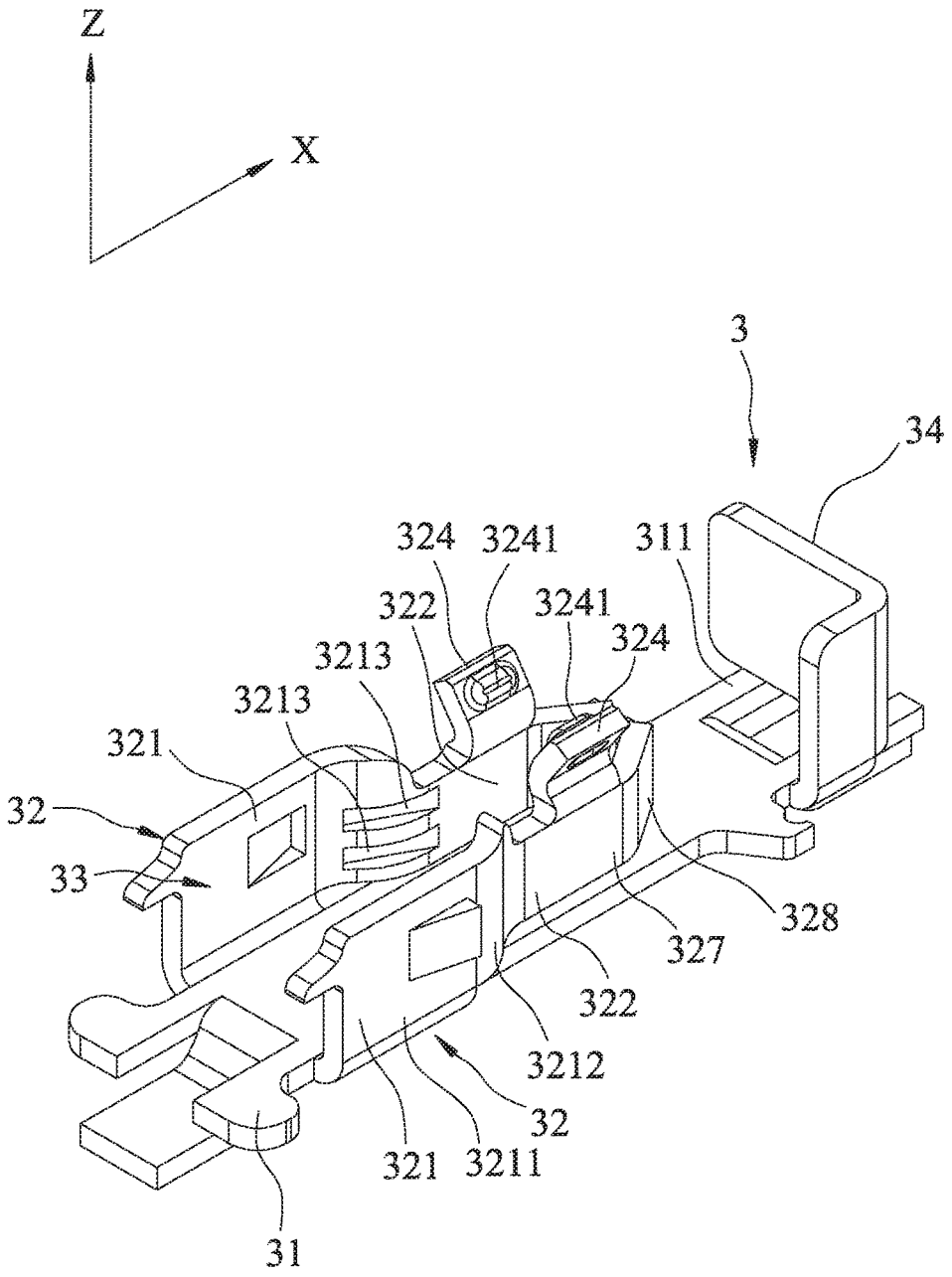
FIG. 5 is a perspective view of a conductive unit of the embodiment.
Figure 6:
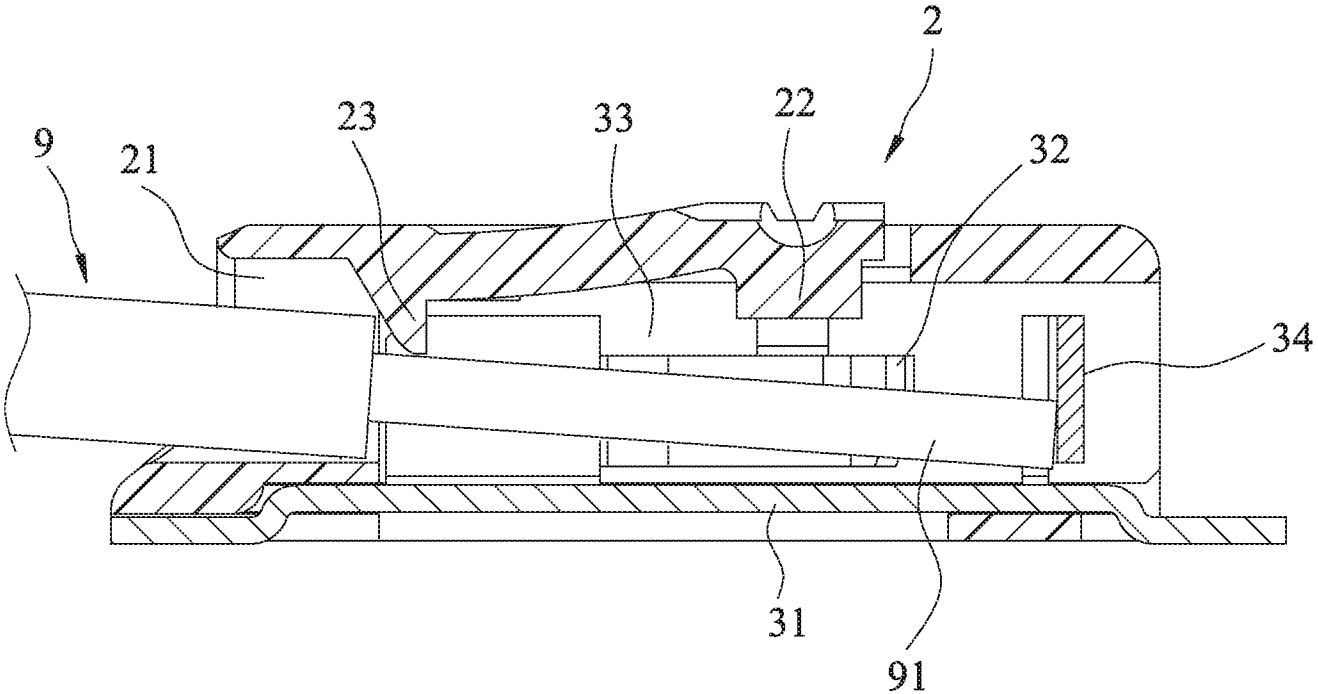
FIG. 6 is a schematic sectional view of the embodiment, illustrating an electrical lead being clamped in the conductive unit.

Referring to FIGS. 4 to 6, an embodiment of the wire terminal connector according to the disclosure is adapted for connecting with an electrical lead 9 (see FIG. 6), and includes an insulating case 2 and a conductive unit 3.

The insulating case unit 2 is formed with an entrance hole 21 that is adapted for the electrical lead 9 to be inserted therethrough. The insulating case unit 2 includes a pressing plate 22 that is operable for a user to press thereon, and a guiding block 23 (see FIG. 6) that is disposed proximate to the entrance hole 21 and that is adapted for guiding the electrical lead 9 to pass through the entrance hole 21.

The conductive unit 3 is electrically conductive, is received in the insulating case unit 2, and includes a base member 31, two resilient clamping plates 32, a receiving space 33 and a stop plate 34.

Each of the resilient clamping plates 32 has a main portion 321, a clamping portion 322, and a pressed portion 324.

The main portion 321 of each of the resilient clamping plates 32 extends from the base member 31. In this embodiment, the main portions 321 of the resilient clamping plates 32 are substantially parallel to each other. Each of the main portions 321 has a flat section 3211 and a shoulder section 3212.

The clamping portion 322 of each of the resilient clamping plates 32 extends from the main portion 321 of a corresponding one of the resilient clamping plates 32 in a direction (X) away from the entrance hole 21 of the insulating case unit 2. The receiving space 33 is defined by the base member 31 and the resilient clamping plates 32, has a quadrilateral cross section, is constricted in the direction (X) away from the entrance hole 21 in a in a stepwise manner, and is adapted for receiving the electrical lead 9. The clamping portions 322 of the resilient clamping plates 32 cooperate to removably clamp the electrical lead 9. The pressed portion 324 of each of the resilient clamping plates 32 extends from the clamping portion 322 of the corresponding one of the resilient clamping plates 32 in a direction (Z) away from the base member 31. The clamping portion 322 of each of the resilient clamping plates 32 has a first height measured from the base member 31, and the main portion 321 of the corresponding one of the resilient clamping plates 32 has a second height measured from the base member 31. The first height of the clamping portion 322 of each of the resilient clamping plates 32 is less than the second height of the main portion 321 of the corresponding one of the resilient clamping plates 32.

The shoulder section 3212 of the main portion 321 of each of the resilient clamping plates 32 extends from the flat plate section 3211 of the main portion 321 of the corresponding one of the resilient clamping plates 32 toward the shoulder section 3212 of the main portion 321 of the other one of the resilient clamping plates 323, and is connected to the clamping portion 322 of the corresponding one the resilient clamping plates 32. The clamping portion 322 of each of the resilient clamping plates 32 has a plate part 327 and a clamping part 328. The plate part 327 of the clamping portion 322 of each of the resilent clamping plates 32 extends from the shoulder portion 3212 of the corresponding one of the resilient clamping plates 32 in the direction (X) away from the entrance hole 21 of the insulating case unit 2. The plate parts 327 of the clamping portions 322 of the resilient clamping plates 32 are substantially parallel to each other. A distance between the clamping parts 328 of the clamping portions 322 of the resilient clamping plates 32 reduces gradually in the direction (X) away from the plate parts 327 of the clamping portions 322, such that the receiving space 33 is tapered in the direction (X) from ends of the clamping parts 328 of the clamping portions 324 of the resilent clamping plates 32 proximate to the plate parts 327 toward ends of the clamping parts 328 of the clamping portions 324 of the resilient clamping plates 32 distal from the plate parts 321.

The stop plate 34 of the conductive unit 3 is disposed on an end 311 of the base member 31 distal from the entrance hole 21 of the insulating case unit 2, and is adapted for an end 91 of the electrical lead 9 to abut thereagainst (see FIG. 6). Therefore, the electrical lead 9 is prevented from passing through the insulating case unit 2.

The shoulder section 3212 of each of the resilient clamping plates 32 is formed with two reinforcing ribs 3213. Each of the resilient clamping plates 32 may be formed with one reinforcing rib 3213 or more than two reinforcing ribs 3213. In this embodiment, the shoulder section 3212 of each of the resilient clamping plates 32 has a stiffness larger than those of the main portion 321 and the clamping portion 322 of the corresponding one of the resilient clamping plates 32.

The pressing plate 22 is operable to press against the pressed portions 324 of the resilient, clamping plates 32. More specifically, the pressed portion 324 of each of the resilient clamping plates 32 is formed with a protrusion 3241 that extends toward the pressing plate 22. The pressing plate 22 is operable to press against the protrusions 3241 of the pressed portions 324 to thereby push the protrusions 3241 away from each other, such that the electrical lead 9 is unclamped from the clamping portions 322 of the resilient clamping plates 32.

Figure 7:
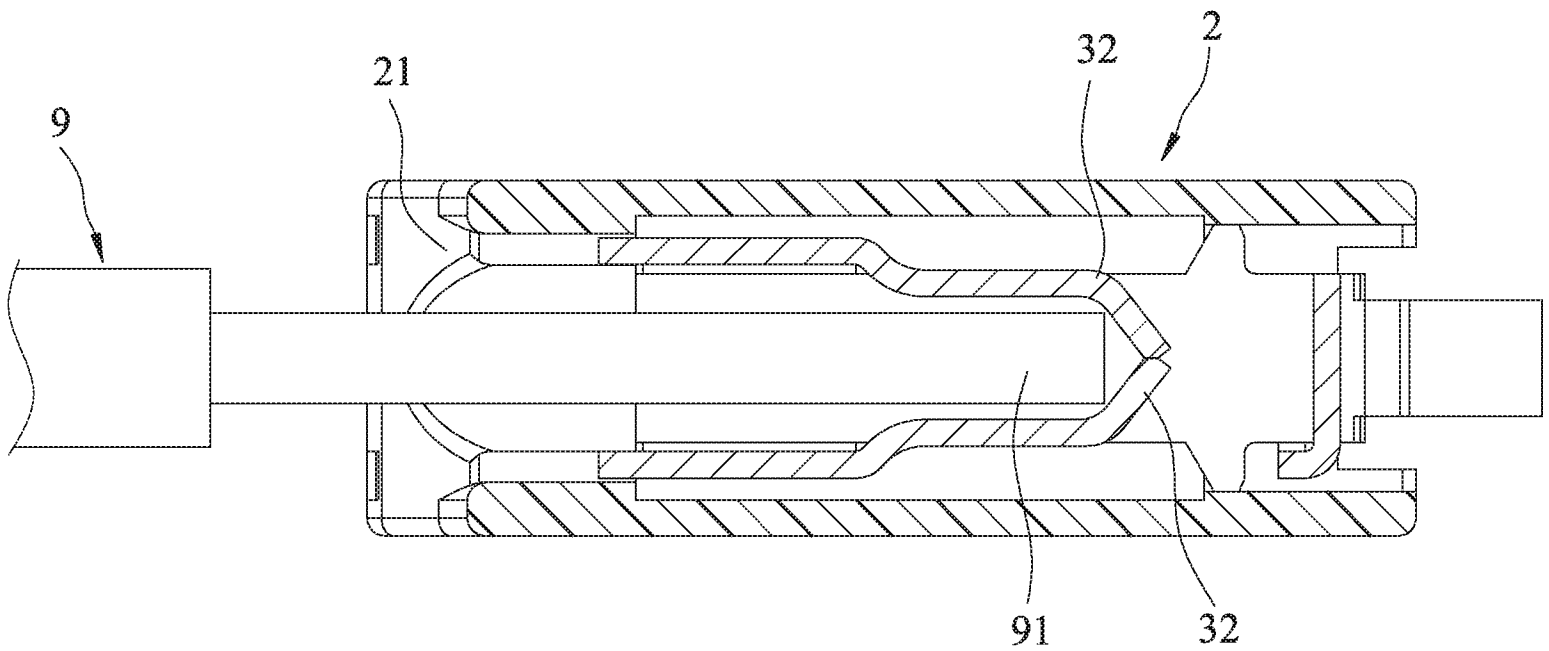
FIGS. 7 and 8 are schematic sectional views of the embodiment, illustrating a process of connecting the embodiment with the electrical lead.
Figure 8:
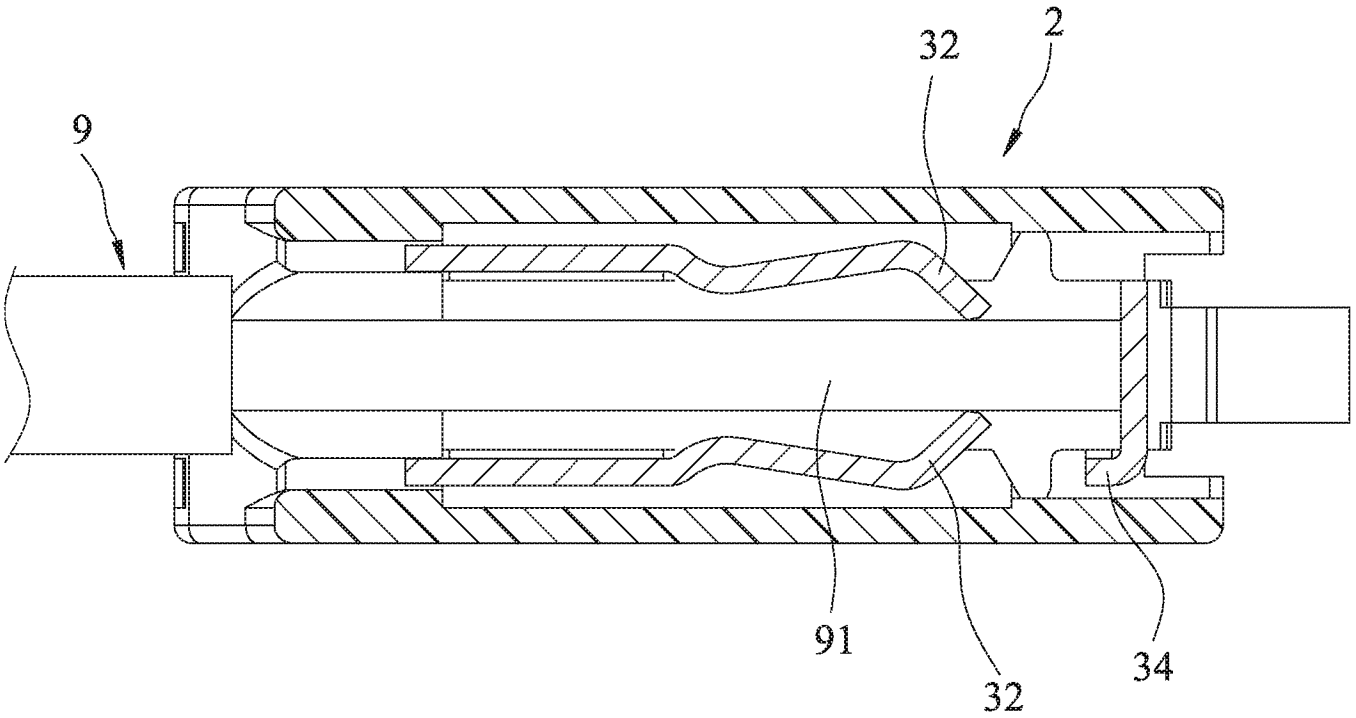

Referring to FIGS. 6 to 8, the electrical lead 9 can be inserted through the entrance hole 21 of the insulating case unit 2, under guide of the guiding block 23, until it abuts against the stop plate 34 of the conductive unit 3, and is clamped by the clamping portions 322 of the resilient clamping plates 32.

Figure 9:
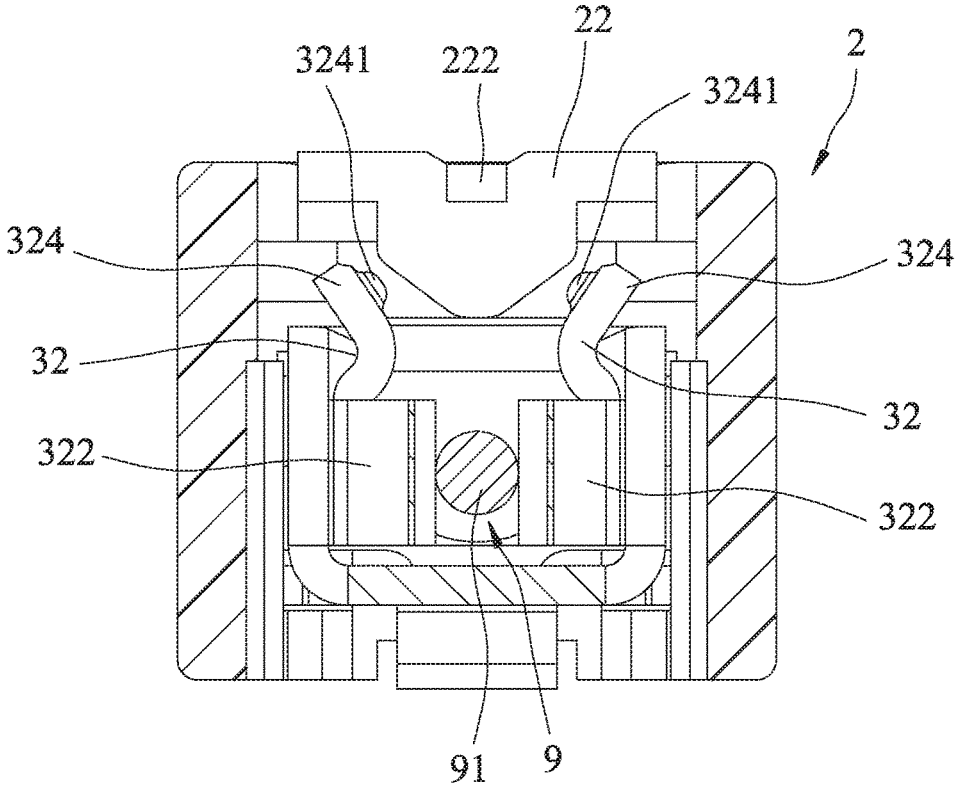
FIGS. 9 and 10 are schematic sectional views of the embodiment, illustrating a process of pressing pressing plate of the embodiment to press against resilient clamping plates of the embodiment.
Figure 10:
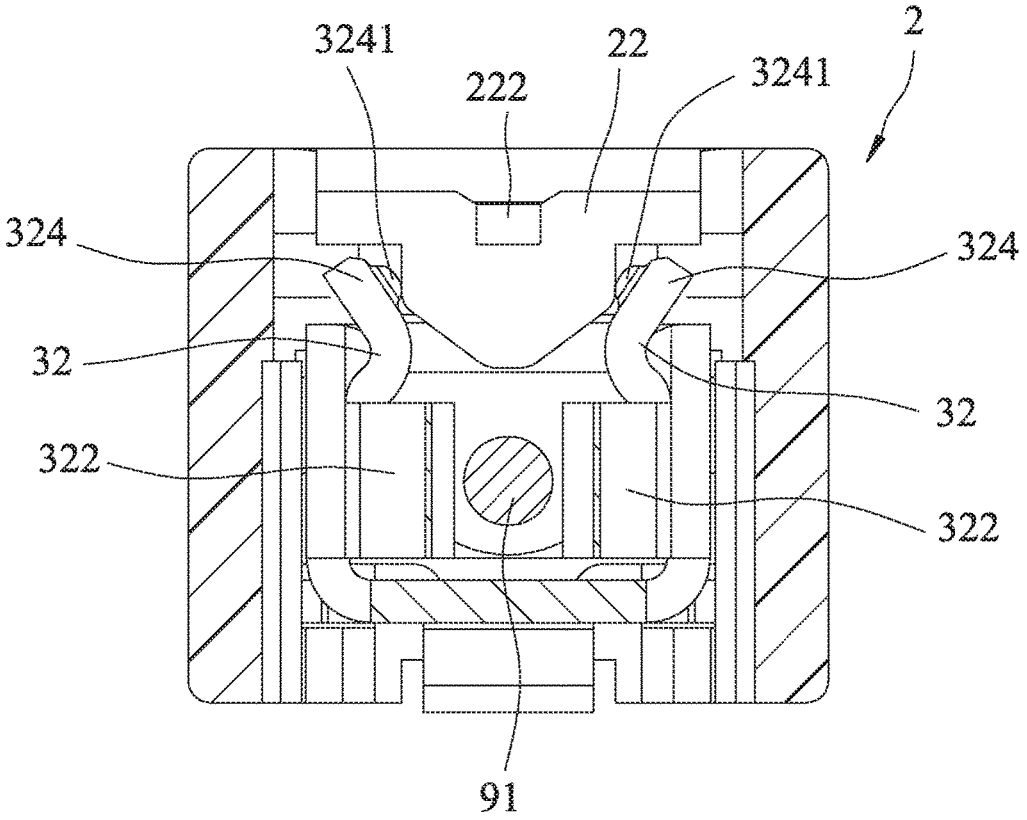
Figure 11:
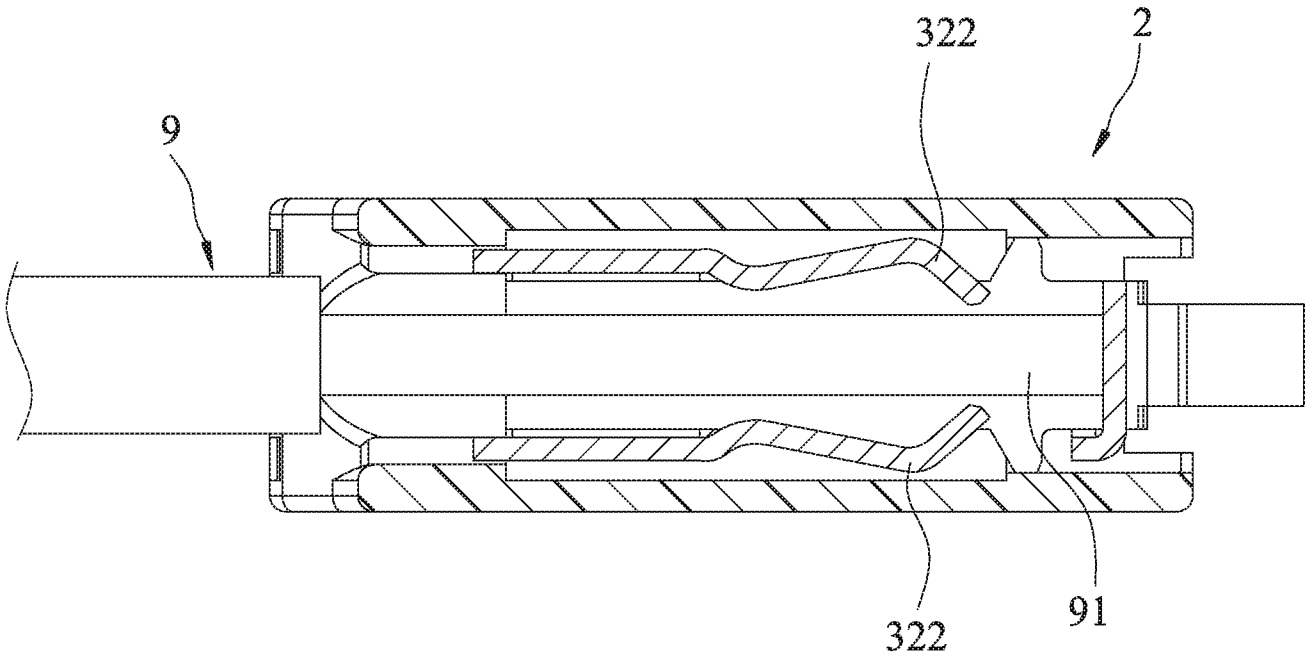
FIG. 11 is a view similar to FIG. 8, but illustrating the electrical lead being unclamped from the conductive unit.
Figure 12:
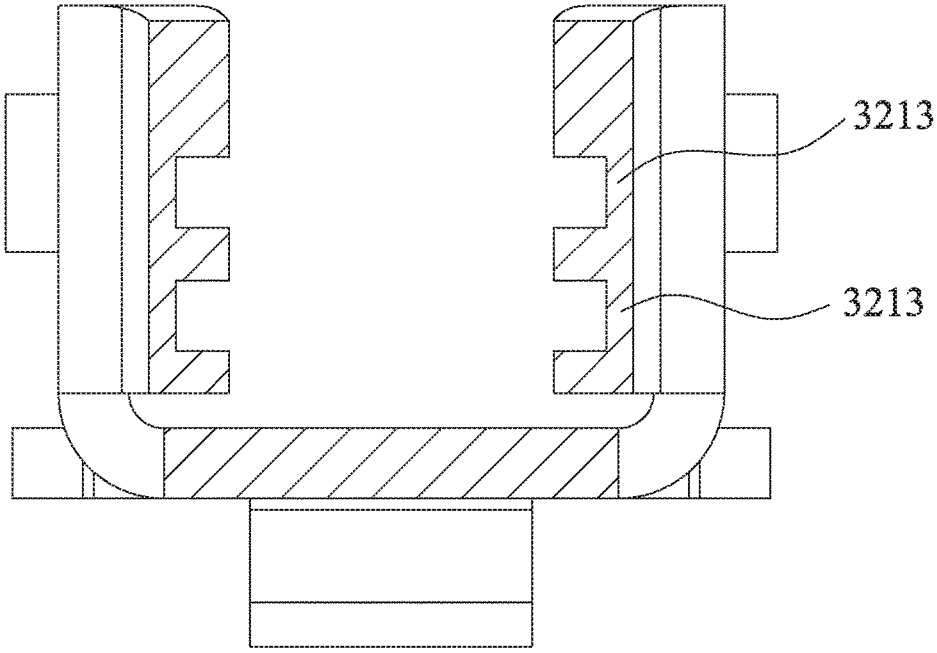
FIG. 12 is a fragmentary sectional view of the conductive unit of the embodiment.

Referring to FIGS. 9 to 11, to disconnect the electrical lead 9 from the wire terminal connector, a user may press the pressing plate 22 with one hand or a tool, such as a screwdriver (not shown), inserted into a recess 222 of the pressing plate 22 for releasing the electrical lead 9.

The merits of the wire terminal connector according to the disclosure are summarized below.

First, the first height of the clamping portion 322 of each of the resilient clamping plates 32 is less than the second height of the main portion 321 of the corresponding one of the resilient clamping plates 32, so that the overall height of the wire terminal connector measured in the direction (Z) is reduced effectively. In practical application, since multiple wire terminal connectors may be used in large-scale electric equipment, a reduction in the wire terminal connector height is highly appreciable.

In addition, with the inclusion of the shoulder sections 3212 of the resilient clamping plates 32 of the conductive unit 3, the length of each of the resilient clamping plates 32 measured in the direction (X) can be increased. As such, although the clamping portions 322 are less than the main portions 321 in height, the volume of the receiving space 33 of the conductive unit 3 may not be reduced by the increase of the length of each of the resilient clamping plates 32, and the electrical lead 9 may be easily connected to the wire terminal connector and may be steadily disposed in the receiving space 33.

Second, with the disposition of the reinforcing ribs 3213 on the shoulder sections 3212 of the resilient clamping plates 32 of the conductive unit 3, the toughness of the resilient clamping plates 32 is increased to avoid the shoulder sections 3212 from fracture. Furthermore, the thicknesses of the main portion 321 and the clamping portion 322 of each of the resilient clamping plates 32 may be reduced, while maintaining sufficient strength by the inclusion of the reinforcing ribs 3213, thereby reducing the weight and the material cost of the wire terminal connector.

It is noted that the reinforcing ribs 3213 of the shoulder sections 3212 of the resilient clamping plates 32 may be formed using stamping techniques, so that each of the reinforcing rib 3213 of the shoulder section 3212 of each of the resilient clamping plates 32 has a density greater than those of adjoining parts of the corresponding resilient clamping plates 32 that are not stamped. The density of the shoulder section 3212 of each of the resilient clamping plates 32 in Z-direction is thus varied, thereby improving the stiffness of the shoulder section 3212 of each of the resilient clamping plates 32.

Third, referring to FIGS. 5 to 9, with the inclusion of the protrusion 3241 on the pressed portion 324 of each of the resilient clamping plates 32, the contact area between the pressing plate 22 of the insulating case unit 2 and the resilient clamping plates 32 is reduced. Therefore, an abrasion of the pressing plate 22 is reduced, and the wire terminal connector is comparatively durable.

Figure 1:
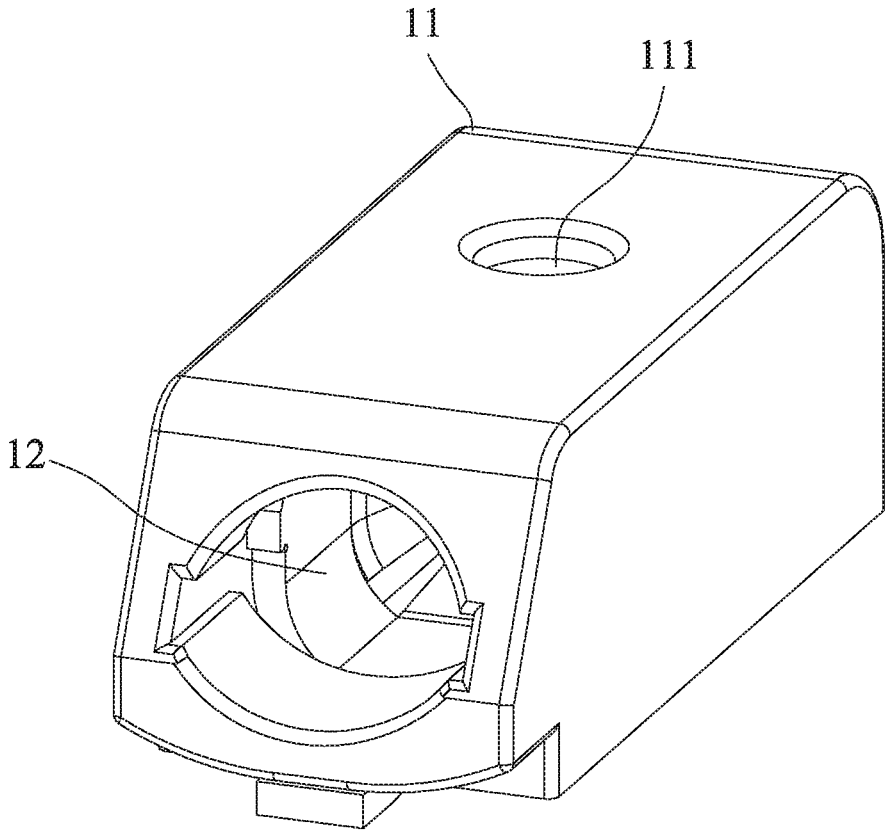
FIG.1 PRIOR ART
FIG. 1 is a perspective view of a conventional wire terminal connector.
Figure 2:
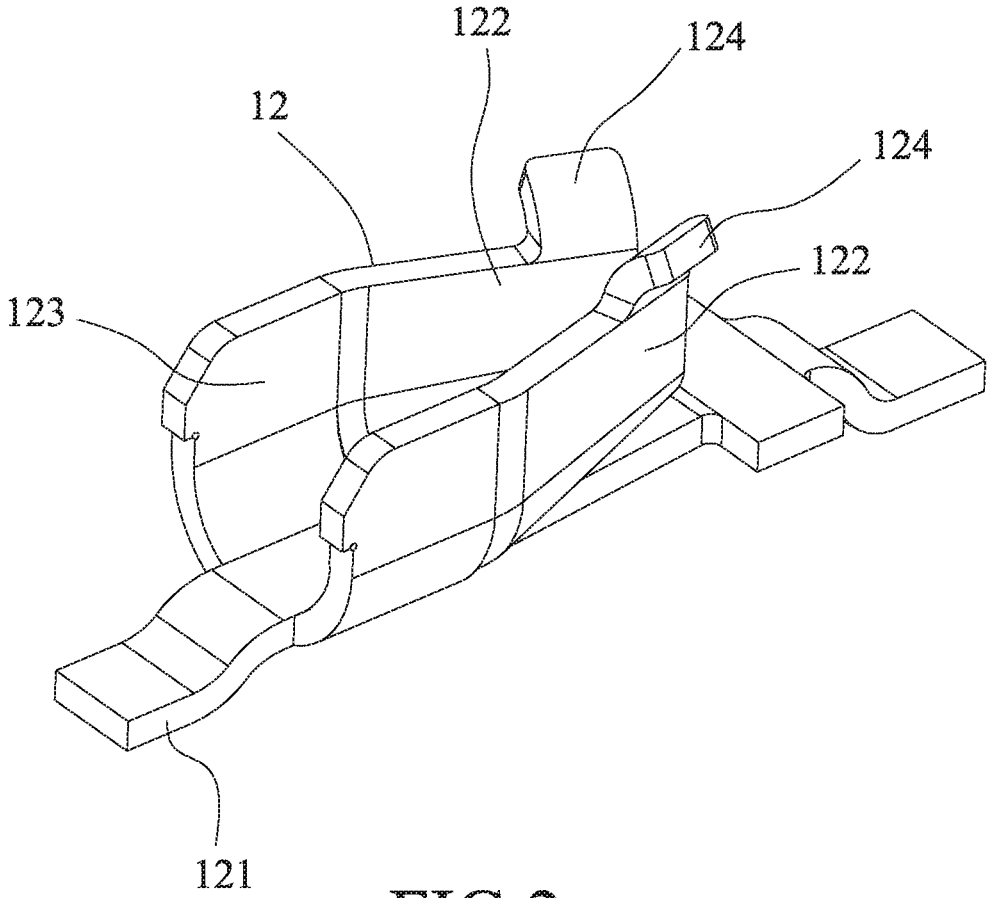
FIG.2 PRIOR ART
FIG. 2 is a perspective view of a conductive unit of the conventional wire terminal connector.
Figure 3:
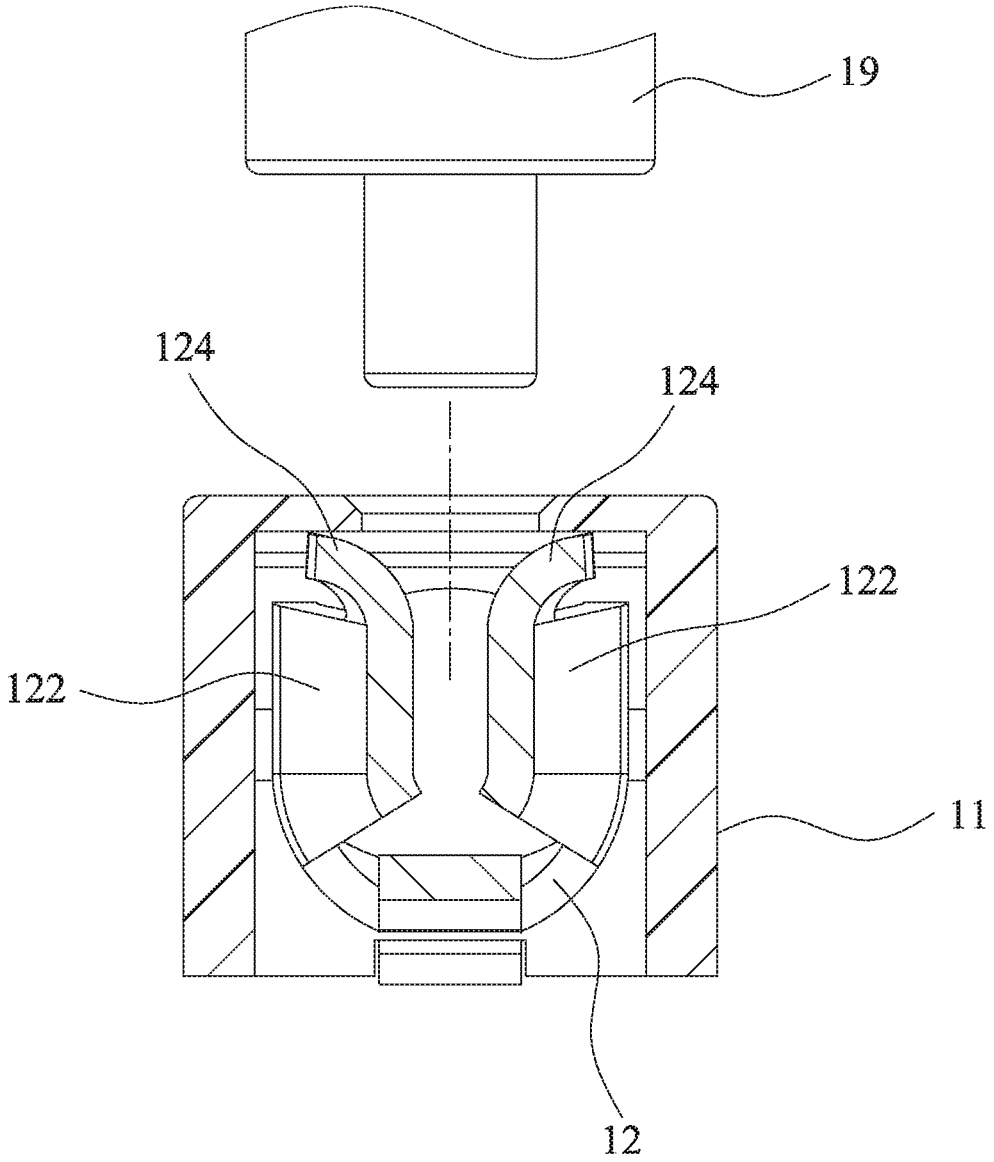
FIG.3 PRIOR ART
FIG. 3 is a schematic view showing a pressing tool being used to press against pressed members 124 of the conventional wire terminal connector.

Lastly, with the inclusion of the pressing plate 22 in the insulating case unit 2, the electrical lead 9 can be disconnected from the wire terminal connector by pressing the pressing plate 22, so that the pressing tool 19 (see FIG. 3) used for the conventional terminal connector can be omitted.

It is noted that, since the first height of the clamping portion 322 of each of the resilient clamping plates 32 is less than the second height of the main portion 321 of the corresponding one of the resilient clamping plates 32, the overall vertical height of the wire terminal connector is reduced for applying effectively to large-scale electronic equipment effectively.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A wire terminal connector adapted for connecting with an electrical lead, said wire terminal connector comprising:

an insulating case unit that is formed with an entrance hole adapted for the electrical lead to be inserted therethrough; and a conductive unit that is received in said insulating case unit, and that includes a base member, two resilient clamping plates and a receiving space, each of said resilient clamping plates having a main portion, a clamping portion and a pressed portion, said main portion of each of said resilient clamping plates extending from said base member, said clamping portion of each of said resilient clamping plates extending from said main portion of a corresponding one of said resilient clamping plates in a direction away from said entrance hole of said insulating case unit, said receiving space being defined by said base member and said resilient clamping plates, having a quadrilateral cross section, being constricted in the direction away from said entrance hole in a stepwise manner and being adapted for receiving the electrical lead, said clamping portions of said resilient clamping plates cooperating to removably clamp the electrical lead, said pressed portion of each of said resilient clamping plates extending from said clamping portion of said corresponding one of said resilient clamping plates in a direction away from said base member, said clamping portion of each of said resilient clamping plates having a height measured from said base member and less than that of said main portion of said corresponding one of said resilient clamping plates;

wherein said main portion of each of said resilient clamping plates has a flat plate section and a shoulder section, said shoulder section of said main portion of each of said resilient clamping plates extending from said flat plate section of said main portion of said corresponding one of said resilient clamping plates toward said shoulder section of said main portion of the other one of said resilient clamping plates and being connected to said clamping portion of said corresponding one of said resilient clamping plates; and wherein said shoulder section of said main portion of each of said resilient clamping plates is formed with at least one reinforcing rib.

2. The wire terminal connector as claimed in claim 1, wherein said shoulder section of said main portion of each of said resilient clamping plates has a stiffness larger than those of said main portion and said clamping portion of said corresponding one of said resilient clamping plates.

3. The wire terminal connector as claimed in claim 1, wherein said conductive unit further includes a stop plate that is disposed on an end of said base member distal from said entrance hole of said insulating case unit, and that is adapted for an end of the electrical lead to abut thereagainst.

4. The wire terminal connector as claimed in claim 1, wherein said clamping portion of each of said resilient clamping plates has a plate part and a clamping part, said plate part of said clamping portion of each of resilient clamping plates extending from said shoulder section of said main portion of said corresponding one of said resilient clamping plates in the direction away from said entrance hole of said insulating case unit, a distance between said clamping parts of said clamping portions of said resilient clamping plates reducing gradually in a direction away from said plate parts of said clamping portions.

5. The wire terminal connector as claimed in claim 4, wherein said main portions of said resilient clamping plates are substantially parallel to each other.

6. The wire terminal connector as claimed in claim 1, wherein said insulating case unit includes a pressing plate that is operable to press against said pressed portions of said resilient clamping plates.

7. The wire terminal connector as claimed in claim 6, wherein said pressed portion of each of said resilient clamping plates is formed with a protrusion extending toward said pressing plate, said pressing plate being operable to press against said protrusions of said pressed portions to thereby push said protrusions away from each other.

* * * * *